US009200857B1

(12) United States Patent
Kellgren

(10) Patent No.: US 9,200,857 B1
(45) **Date of Patent: *Dec. 1, 2015**

(54) HOLLOW HAMMER WITH DOWNWARD EJECTING CHAMBER FOR RIFLE

(71) Applicant: George Kellgren, Cocoa, FL (US)

(72) Inventor: George Kellgren, Cocoa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/674,976

(22) Filed: Mar. 31, 2015

Related U.S. Application Data

(62) Division of application No. 14/097,712, filed on Dec. 5, 2013, now Pat. No. 9,021,935.

(51) Int. Cl.
*F41A 5/18* (2006.01)
*F41A 7/00* (2006.01)

(52) U.S. Cl.
CPC .... *F41A 5/18* (2013.01); *F41A 7/00* (2013.01)

(58) Field of Classification Search
CPC ..... F41A 5/18; F41A 5/20; F41A 5/22; F41A 5/24; F41A 9/54–9/57; F41A 9/61; F41A 15/00; F41A 15/08; F41A 15/12; F41A 17/38; F41A 19/00; F41A 19/06; F41A 19/10; F41A 19/14
USPC ..... 89/193
See application file for complete search history.

(56) References Cited

U.S. PATENT DOCUMENTS

| | | | | |
|---|---|---|---|---|
| 4,035,943 | A | 7/1977 | Civolani | |
| 4,562,659 | A | 1/1986 | Neta | |
| 4,635,530 | A | 1/1987 | Weldle | |
| 4,677,781 | A | 7/1987 | Lee | |
| 4,905,394 | A | 3/1990 | Predazzer | |
| 5,834,678 | A | 11/1998 | Kalb | |
| 6,625,917 | B2 | 9/2003 | Murello | |
| 7,047,684 | B2 * | 5/2006 | Roh | 42/16 |
| 7,231,864 | B2 * | 6/2007 | Ratti | 89/161 |
| 7,448,307 | B1 | 11/2008 | Dafinov | |
| D665,042 | S | 8/2012 | Kellgren | |
| 8,782,940 | B1 | 7/2014 | Morris | |
| 8,806,788 | B1 | 8/2014 | Hu | |
| 8,931,393 | B1 | 1/2015 | Vincent | |
| 2004/0244261 | A1 | 12/2004 | Roh | |
| 2005/0235546 | A1 | 10/2005 | Wonisch | |

(Continued)

OTHER PUBLICATIONS

Bullpup, retrieved on Nov. 7, 2013, retrieved from http://en.wikipedia.org/wiki/Bullpup, 5 pages.

*Primary Examiner* — Joshua Freeman
(74) *Attorney, Agent, or Firm* — Brian S. Steinberger; Law Offices of Brian S. Steinberger, P.A.

(57) ABSTRACT

Methods, devices, apparatus and systems for a downward ejecting rifle configured with a trigger and grip mounted forward of a magazine. The rifle includes a receiver with a bolt assembly slidably located therein, a rifle barrel connected with the receiver with a cartridge chamber, the barrel arranged to mate with a bolt mechanism located rearward of the trigger and grip, and a downward ejection port rearward of the magazine to allow a spent casing to eject downward from the rifle. The downward ejection port includes an oversized hollow hammer pivotally connected with a trigger assembly such that after firing the bolt mechanism travels rearward extracting the spent casing over and behind the magazine where it is ejected through the oversize hollow hammer. Downward ejection mechanisms can include a hollow ejection chute reward of the magazine below the hollow hammer with ejected casings passing downward through the ejection chute.

13 Claims, 9 Drawing Sheets

(56) References Cited

U.S. PATENT DOCUMENTS

| | | | |
|---|---|---|---|
| 2006/0027091 | A1 | 2/2006 | Ratti |
| 2006/0048424 | A1 | 3/2006 | Weir |
| 2011/0283582 | A1 | 11/2011 | Hunter |
| 2013/0185975 | A1 | 7/2013 | Johnson |
| 2014/0000143 | A1 | 1/2014 | Safewright |
| 2014/0075803 | A1 | 3/2014 | Muller |
| 2014/0075812 | A1 | 3/2014 | Johnson |
| 2014/0360076 | A1 | 12/2014 | Zamlinsky |

* cited by examiner

HOLLOW HAMMER WITH DOWNWARD EJECTING CHAMBER FOR RIFLE

This application is a divisional application of U.S. patent application Ser. No. 14/097,712 filed on Dec. 5, 2013, now U.S. Pat. No. 9,021,935, which is incorporated by reference in its' entirety.

FIELD OF THE INVENTION

This invention relates to firearms and, in particular, to methods, systems, apparatus and devices for a downward ejecting firearm in which hollow hammer mechanism and the magazine are located behind the trigger and spent cartridges are ejected downward.

BACKGROUND AND PRIOR ART

Bullpup refers to a firearm configuration in which the mechanism and magazine are located behind the trigger so there is no wasted space for the butt stock as in conventional designs. This bullpup configuration increases the barrel length relative to the overall weapon length, thus permitting a shorter firearm length for the same barrel length or longer barrel for the same weapon length. Bullpups generally allow for a 25% reduction in weapon length, which allows for better maneuverability in confined spaces.

Being held closer to the body, the bullpup design has the advantage of causing less fatigue to the user's positioning arm when the arm is outstretched for long periods of time. Being more compact and having a shorter length allows for greater close-in weapons usage especially in urban environments. There is also a shorter reaction time advantage in raising a bullpup to fire from a downward pointed direction, a result consistent with a lighter weapon. The bolt may also have to be smaller to be able to fit in the stock, with reduced components, resulting in reduced overall weight.

The main disadvantages of the bullpup firearm are ejection interference in some firing positions, short sight radius, and a higher risk of injury at catastrophic breach failures. Nevertheless, a number of bullpup rifles are now in service all over the world.

Generally, bullpups have their ejection port on the right-hand side and eject spent cartridge casings towards the right. Certain designs, such as the FAMAS (France) assault rifle and the AUG (Austria), overcome this limitation by allowing the bolt and ejection port cover to be swapped, turning the weapon into a dedicated left-handed version. Other bullpups such as the Kel-Tec RFB, the Fabrique National's FN-2000 and the Russian A-91 solve the problem by ejecting forward of the rifle. However, the forward ejecting configurations are all quite complex due to the awkward routing of the ejecting cases.

Downward ejection is used in the FN P-90 by using a magazine that is mounted on top of the barrel which limits the magazine to very short cartridges. Most belt-fed machine guns also feature downward ejection. The Interdynamic MKR was ejecting behind the magazine. However the MKR fired from open bolt due to the limited space for the mechanisms behind the magazine.

FIG. 20 is a perspective view of a prior art side ejecting firearm 120 with the magazine located behind the trigger in a bullpup configuration. Casing ejection is then produced by the ejector located above the magazine, which strikes against the cartridge casing bottom during return of the bolt assembly. The cartridge is tilted laterally by the extractor and ejected through a side eject port 130 in the weapon housing.

In simply configured automatic weapons, for example, in the Soviet assault rifle AK-47 (Kalaschnikov), casing ejection is produced through a protrusion fixed on the housing. The bottom of the cartridge casing strikes against this protrusion during return of the bolt assembly.

Other weapons have a casing ejector arranged in the center, so that the casings are ejected upward. For weapons of the bullpup design, a center cartridge ejector is unsuitable, since the casings, as described above, are ejected at the site at which the shooter positions his head against the weapon for aiming.

What is needed to solve the above mentioned problems is to improve the functioning of the downward ejecting bullpup rifle through a simpler, more compact and easier to manufacture ejection mechanism.

SUMMARY OF THE INVENTION

A primary objective of the present invention is to provide methods, systems, apparatus and devices for a firearm which is capable of ejecting spent casings in a safe downward direction.

A secondary objective of the present invention is to provide methods, systems, apparatus and devices for a downward ejection firearm of the bullpup configuration with a simpler, more compact ejection mechanism that is easier to manufacture.

A third objective of the present invention is to provide methods, systems, apparatus and devices for a downward ejection firearm of the bullpup configuration with an oversize hollow hammer for downward ejection of the spent cartridge casing. The ejection can e aided by an ejection chute located behind the magazine.

A first embodiment provides a gas operated rifle configured with a trigger and grip mounted forward of a magazine that includes a receiver assembly having a bolt assembly slidably located therein, a rifle barrel connected with the receiver and having a cartridge chamber, the barrel arranged to mate with the bolt assembly located rearward of the trigger and grip, an hollow hammer pivotally attached to a trigger mechanism and a downward ejection chamber, the hollow hammer rotating a distance behind a magazine and below a bolt to allow a spent case withdrawn from the barrel by a bolt to be ejected downward through the hollow hammer into the downward ejection chamber.

The hollow hammer includes an u-shaped hammer pivotally connected at a first pivot point to a lower receiver and connected at a second pivot point to the trigger mechanism on each side of the rifle. The u-shaped hammer includes an elongated top section forming a hammer head at a distal end, the elongated top section integrated with a left and a right leg extending downward from an opposite end of the top section, each left and right leg pivotally connected to the trigger mechanism.

The rifle downward ejection port includes a rectangular hollow ejection chute connected to the lower receiver reward of the magazine below the elongated top section of the hollow hammer, the ejected case passing downward through the ejection chute.

A second embodiment provides a rifle for downward ejecting a spent casing from a firearm with a magazine located reward of a trigger and grip with a hollow hammer pivotally connected with a trigger assembly on each side of a magazine, the hollow hammer oversized to rotate a distance behind the magazine and below a bolt to allow a spent case withdrawn from the barrel by the bolt to be ejected downward through the hollow hammer. The hollow hammer includes an elongated top section forming a hammer head at a distal end, the elongated top section integrated with a left and a right leg extending downward from an opposite end of the top section and a left and right hammer bar pivotally connected to the left and right leg, respectively, to pivotally connect the hollow hammer with the trigger assembly on each side of the magazine. The rifle can include a hollow ejection cute rearward of the magazine below the elongated top section of the hollow hammer with the left and right leg of the hollow hammer pivotally connected with a lower receiver on each side of the firearm, the bolt traveling rearward above the hollow ejection chute to eject the spent case through the hollow hammer into the hollow ejection chute.

A third embodiment provides a downward ejecting rifle that includes a rifle configured with a trigger and grip mounted forward of a bottom loading magazine including a lower receiver assembly and an upper receiver assembly having a bolt carrier assembly slidably located therein, the upper receiver assembly attached to the lower receiver assembly, a rifle barrel connected with the lower receiver assembly and having a cartridge chamber, the barrel arranged to mate with a bolt carrier mechanism located rearward of the trigger and grip, and a hollow hammer mechanism pivotally connected with a trigger assembly such that after firing the bolt mechanism travels rearward extracting a spent casing over and behind the magazine where it is ejected through the hollow hammer.

The hollow hammer includes a u-shaped hollow hammer including an elongated top section forming a hammer head at a distal end, the elongated top section integrated with a left and a right leg extending downward from an opposite end of the top section, each left and right leg pivotally connected on both sides with the trigger assembly. The left and the right leg of the hollow hammer is connected to a left and a right hammer bar connected with the trigger assembly on each side of the magazine to allow the hollow hammer to rotate about a first axis and the left and the right leg of the hollow hammer is connected to a left and right side of the lower receiver assembly to allow the hollow hammer to pivot about a second axis below the first axis.

The rifle can include a left and right hammer pivot bracket connected with the lower receiver assembly for pivotally connecting the hollow hammer with the lower receiver assembly to allow the hollow hammer to pivot about a second axis below a first axis, wherein the left and the right leg of the hollow hammer is connected to a left and right hammer pivot bracket, respectively, the left and right pivot bracket connected to the lower receiver assembly to pivotally connect the hollow hammer to the lower receiver assembly. The rifle can also include a rectangular hollow ejection chute reward of the magazine below the elongated top section of the hollow hammer between the left and right leg of the hollow hammer, the ejected case passing through the hollow hammer downward through the ejection chute. The rectangular hollow ejection chute is connected to the lower receiver assembly.

The novel rifle with the downwardly ejecting cartridges/shells allows for users to hold and fire the rifle when holding it to their left or right sides. There is substantially less injury to the users with the novel downwardly ejecting rifle. The novel rifle is more versatile in closed small environments, such as in military transport vehicles. Picking up the spent shells is much easier with the downwardly ejecting rifle since the spent cartridges/shells fall in one place.

Further objects and advantages of this invention will be apparent from the following detailed description of preferred embodiments which are illustrated schematically in the accompanying drawings.

DESCRIPTION OF THE PREFERRED EMBODIMENTS

Figure 1:
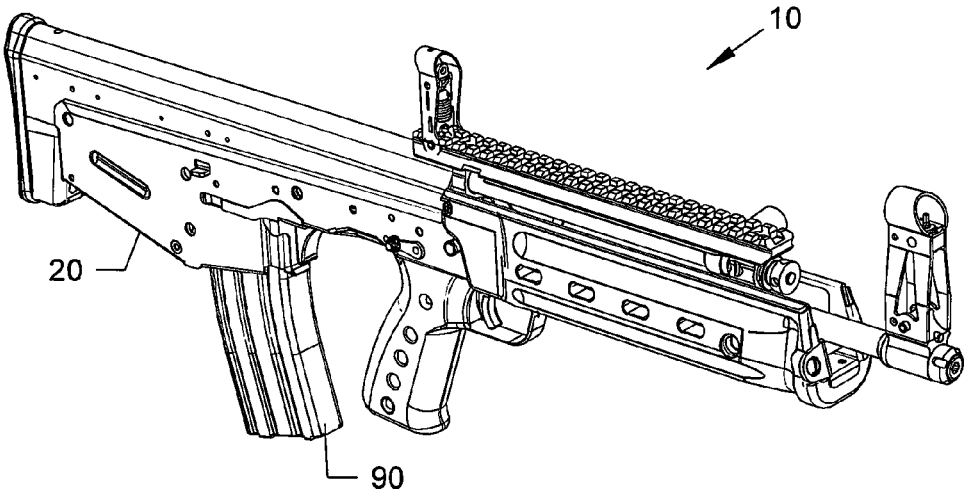
FIG. 1 is a front perspective of rifle with downward eject feature.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Listed below are the components of the downward ejection firearm with ejection mechanism and magazine located behind the trigger group as shown in FIGS. 1-15:

10 Rifle with downward eject feature
20 Ejection chute
23 Top of ejection chute
25 Bottom of ejection chute
30 Hammer
40 Bolt
50 Firing pin
60 Firing chamber

70 Spent cartridge case
80 Bullet cartridge
90 Ammunition magazine
100 Trigger
110 Hammer bar
120 Example of a rifle with a side eject feature (Prior Art shown in FIG. 20)
130 Side eject port (Prior Art shown in FIG. 20)
140 Receiver
150 Hammer pivot bracket
160 Hammer pivot pin It would be useful to discuss the meanings of some words used herein and their application before discussing the firearm of the present invention with a downward ejecting mechanism.

"Ammunition," "cartridge", "shell" and "round" are used interchangeably to mean a cylindrical, usually metal casing containing the primer and powder charge and bullet for a firearm. Spent cartridge and spent shell includes the cylindrical casing after the bullet is fired therefrom.

"Firearm," "rifle", and "bullpup" are used interchangable to refer to all weapons to which a tubular magazine, barrel and stock in which the firing mechanism and magazine are located behind the trigger group.

The directional terms "horizontal," "vertical," "front," "forward," "rear," "rearward," "right," and "left" refer to the firearm when held in the normal firing position. When firing, the rear end of the firearm is close to or in close proximity to the body of the user, while the front end is farthest from the user and the point at which the ammunition exits the firearm.

Figure 9:
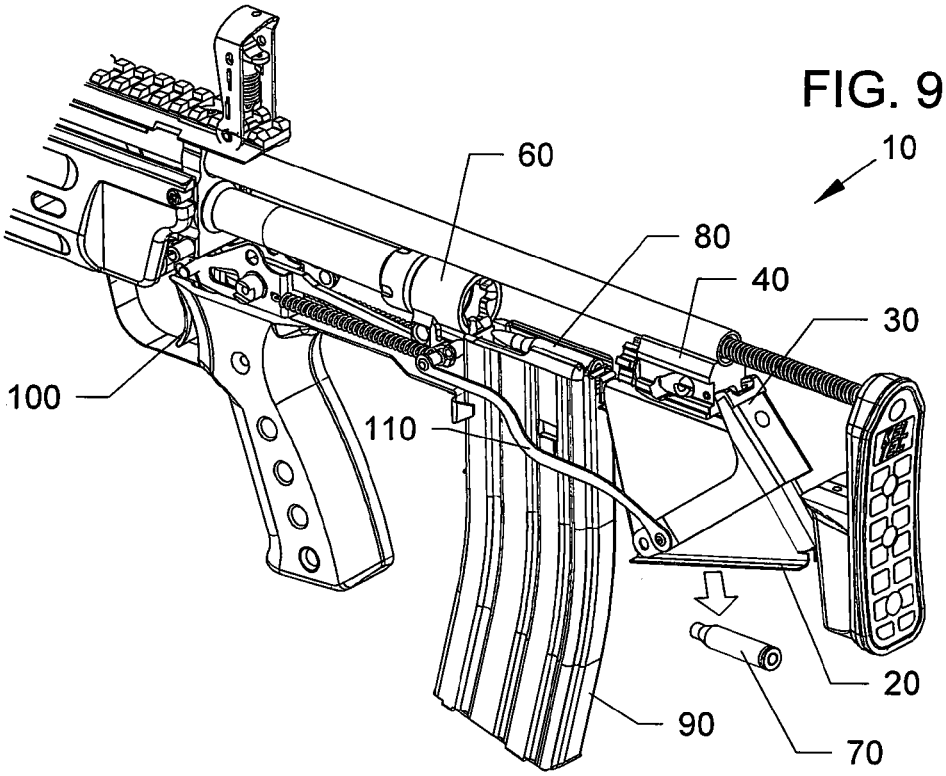
FIG. 9 shows the spent casing exiting the bottom of the ejection chute as the bolt moves forward to accept a new cartridge from the magazine.
Figure 20:
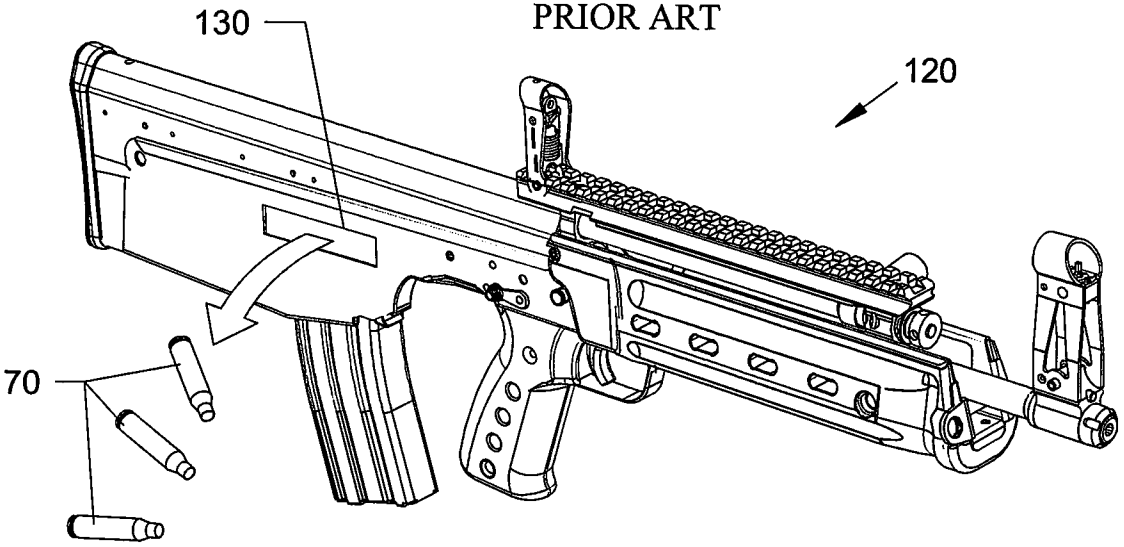
FIG. 20 PRIOR ART
FIG. 20 is a perspective view of a prior art side ejecting firearm with the magazine located behind the trigger.

FIG. 1 is a front perspective of a shoulder fired bullpup rifle 10 with a downward ejection feature showing a cover over the firing mechanism and ejection chute 20. The term bullpup refers to a firearm configuration in which the mechanism and magazine are located behind the trigger so there is no wasted space for the butt stock as in conventional designs. FIG. 20 shows an example of a side ejection bullpup firearm with spent cartridges ejected from the right side, close to the user's face. In comparison, FIG. 9 shows the spent casing exiting the bottom of the downward ejection chute.

Figure 2:
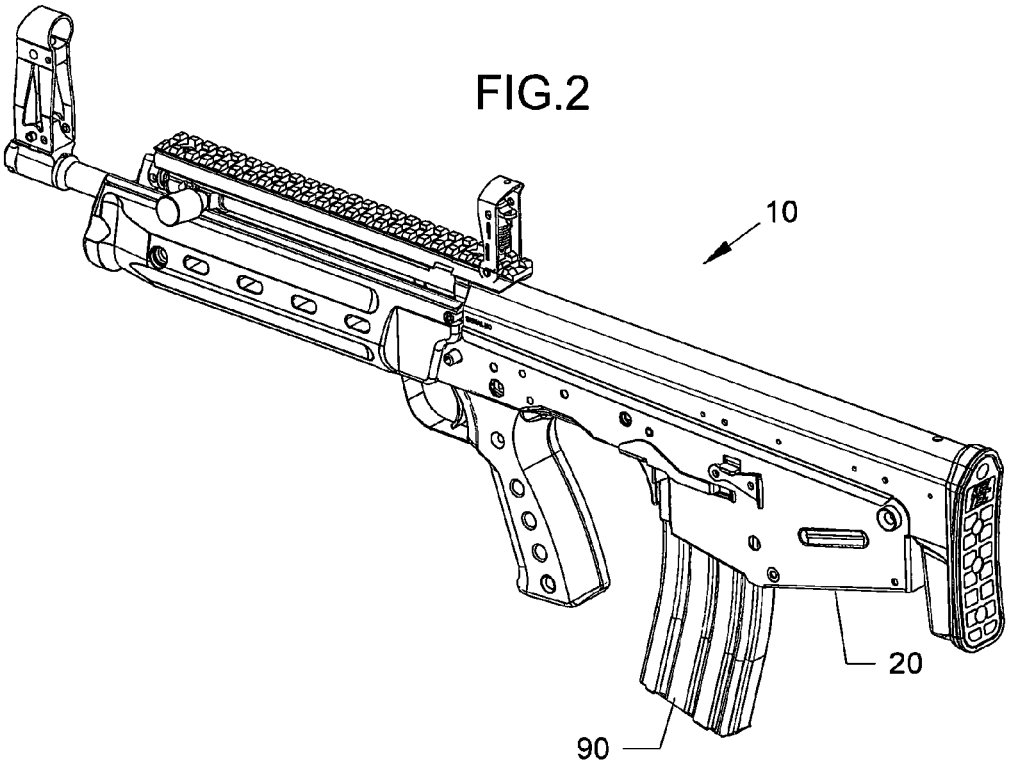
FIG. 2 is a rear perspective view of the rifle shown in FIG. 1.
Figure 3:
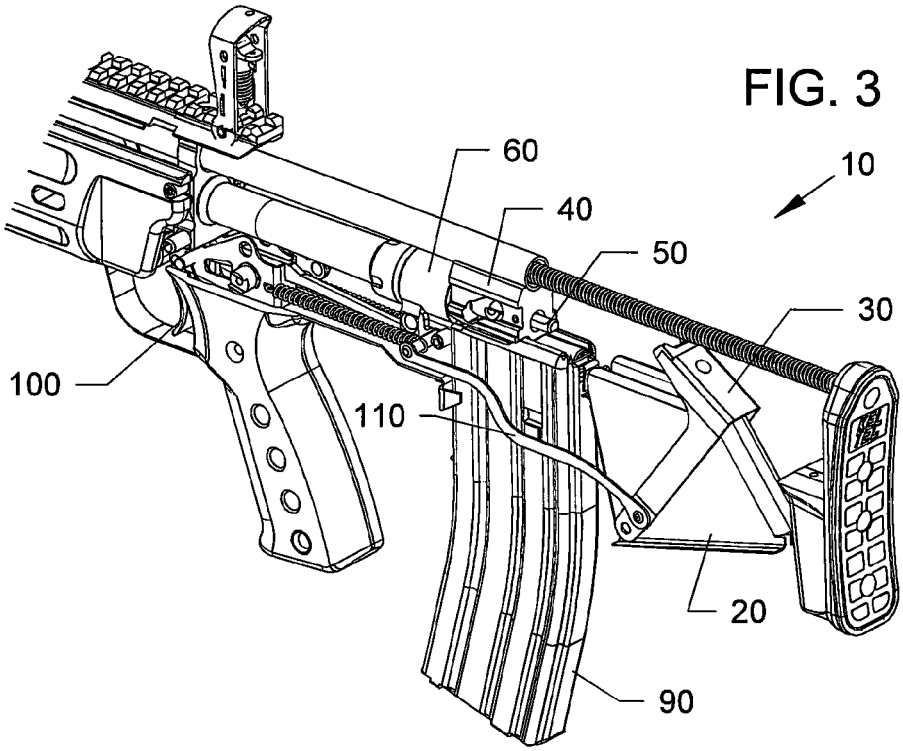
FIG. 3 is a partial rear perspective of the rifle with the obscuring components removed to show the downward ejection feature.

FIG. 2 is a rear perspective view of the rifle shown in FIG. 1 from an opposite side. In the example shown, the firing mechanism and the ejection chute are not visible. FIG. 3 is a partial rear perspective of the rifle with the obscuring components removed to show the downward ejection feature. Other parts of the rifle 10 are known in the art. The bolt mechanism includes a bolt carrier connected with a slidable bolt 40 within the housing, a firing pin 50, and a magazine 90 that works with the bolt mechanism. The trigger 100 and grip are mounted forward of the magazine 90 and the trigger is connected to the hammer 30 via a hammer transfer bar 110.

As the bolt carrier is pulled rearward, the bolt 40 clears the magazine 90 pushing the hammer to the reward position shown in FIG. 3. During the return of the bolt 40, the bolt 40 travels forward, moving a first round from the magazine 90 into the firing chamber 60. In FIG. 3 there is a round in the chamber and the hammer is cocked. The rifle is ready to fire.

Figure 4:
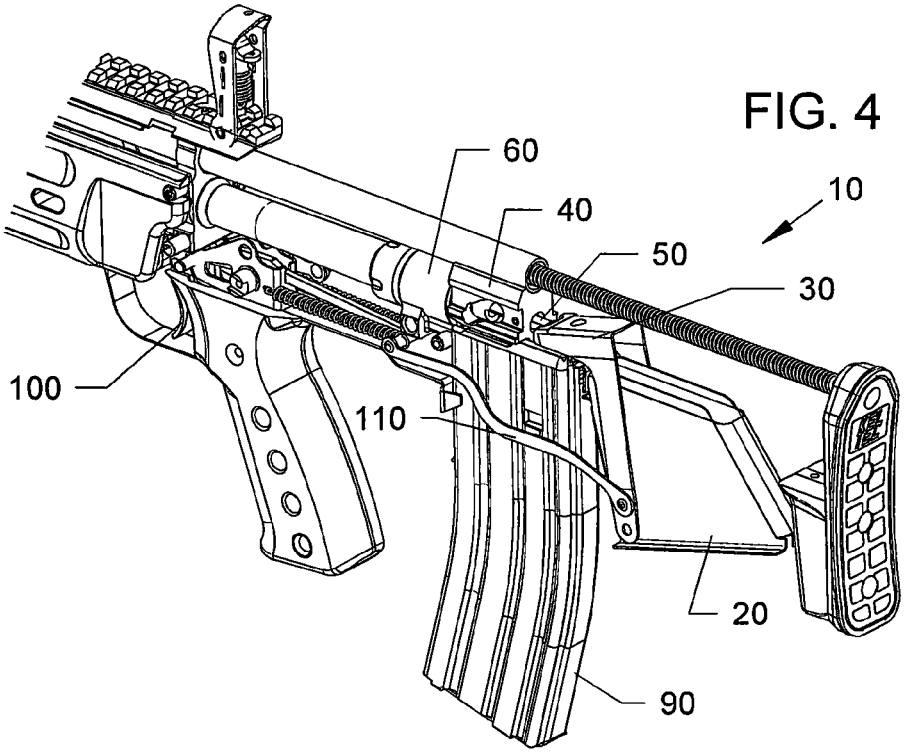
FIG. 4 shows the trigger pulled and the hammer rotated forward striking the firing pin which fires the round in the chamber.
Figure 5:
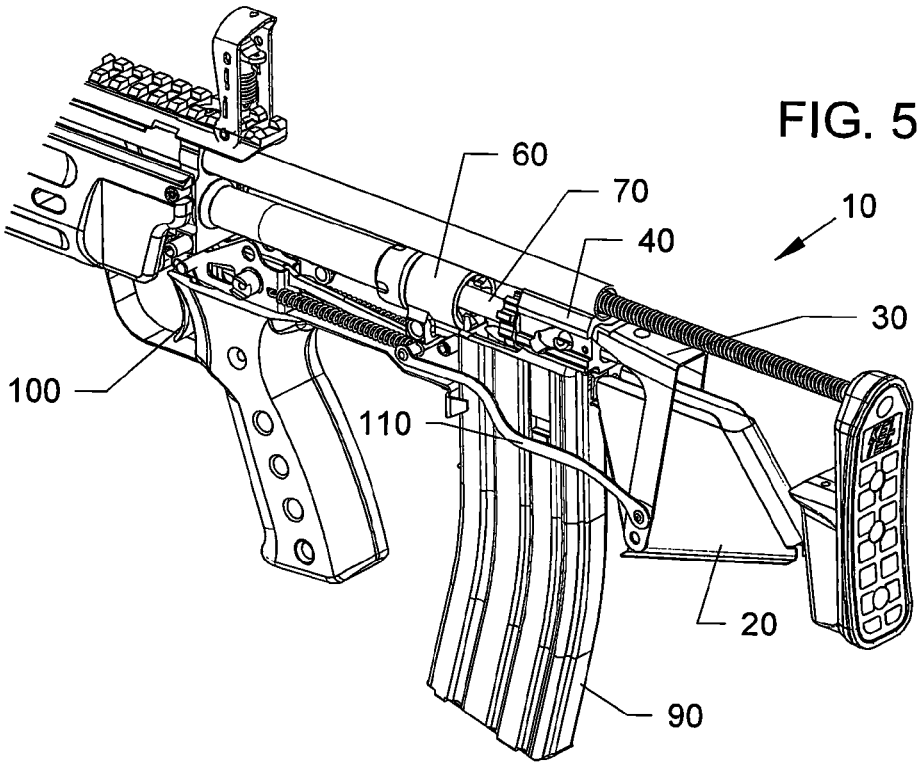
FIG. 5 shows the bolt moved back to extract the spent casing from the chamber, simultaneously cocking the hammer.

FIG. 4 shows the trigger 100 pulled and the hammer 30 rotated forward striking the firing pin 50. The firing pin then travels forward making contact with the primer of the chambered cartridge 80 with sufficient inertial force to detonate the primer discharging said cartridge 30. After firing, the bolt 40 extracts and ejects the spent cartridge casing 70 being assisted by gases from the cartridge 30. As the bullet travels down the barrel 8 it reaches the gas port, a small hole in the barrel, the bullet passes the hole and small amount of high pressure gas from the expanding cartridge 80 enters the hole and is directed rearward to push the bolt carrier rearward.

Figure 6:
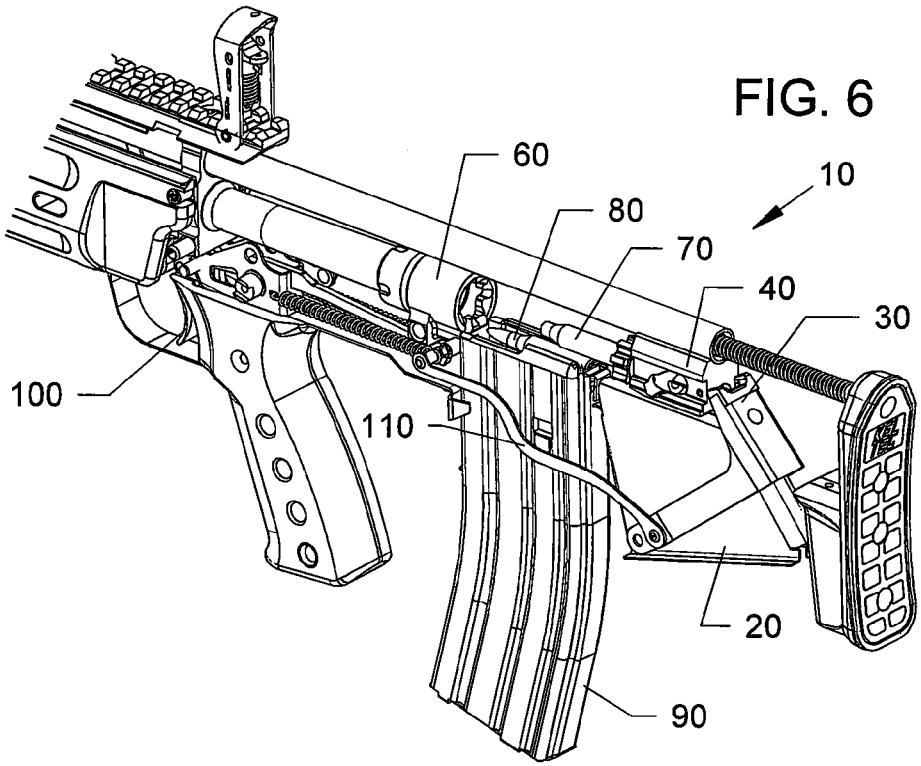
FIG. 6 shows the bolt carrying the spent casing toward the ejection chute.
Figure 7:
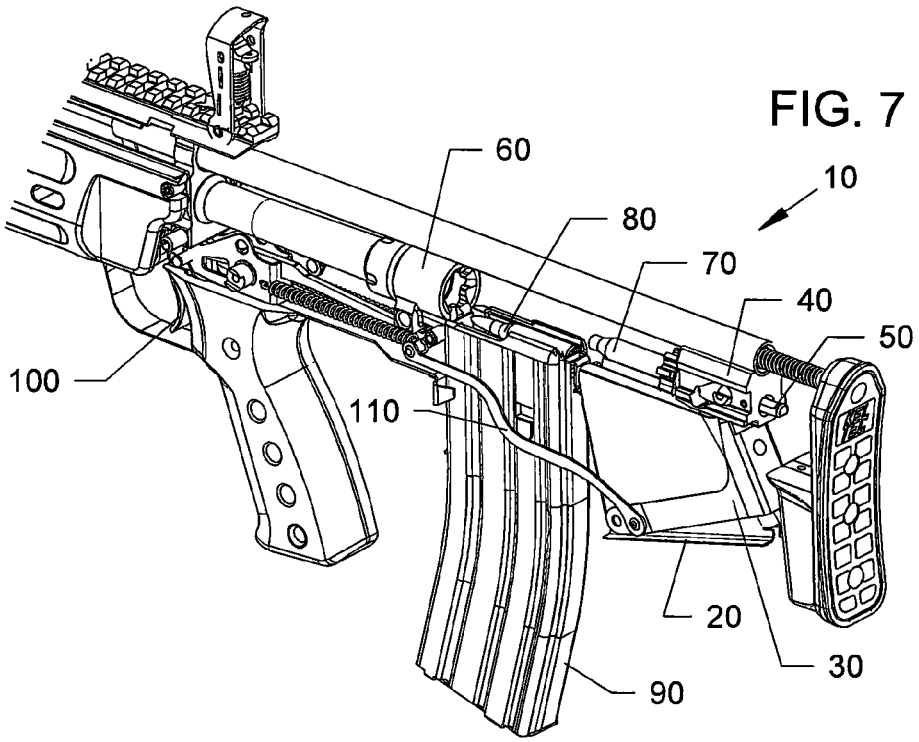
FIG. 7 shows the spent case clear of the magazine and positioned over the ejection chute.

FIG. 6 shows the bolt 40 moved back to extract the spent casing 70 from the chamber, simultaneously cocking the hammer 30. As the bolt 40 is forced rearward, extracting the spent cartridge casing 70 as shown in FIG. 6, the spent casing 70 passes over the magazine 90 to the downward ejection chute 20 that is connected to the lower received as shown in FIG. 7.

Upon firing, the bolt 40 assembly travels rearward and extracts the spent casing 70 over and behind the magazine 90 where it can be ejected by a spring loaded ejector on top and an extractor on the bottom. The case rotates down through an oversize hollow hammer 30

The downward ejection firearm includes an oversize hollow hammer 30 for ejection of the spent casing 70 and the ejection cute 20 connected to the lower receiver. FIG. 7 shows the spent casing 70 clear of the magazine 90 and positioned over the ejection chute 20. A new cartridge 80 can be seen in the magazine 90.

Figure 21:
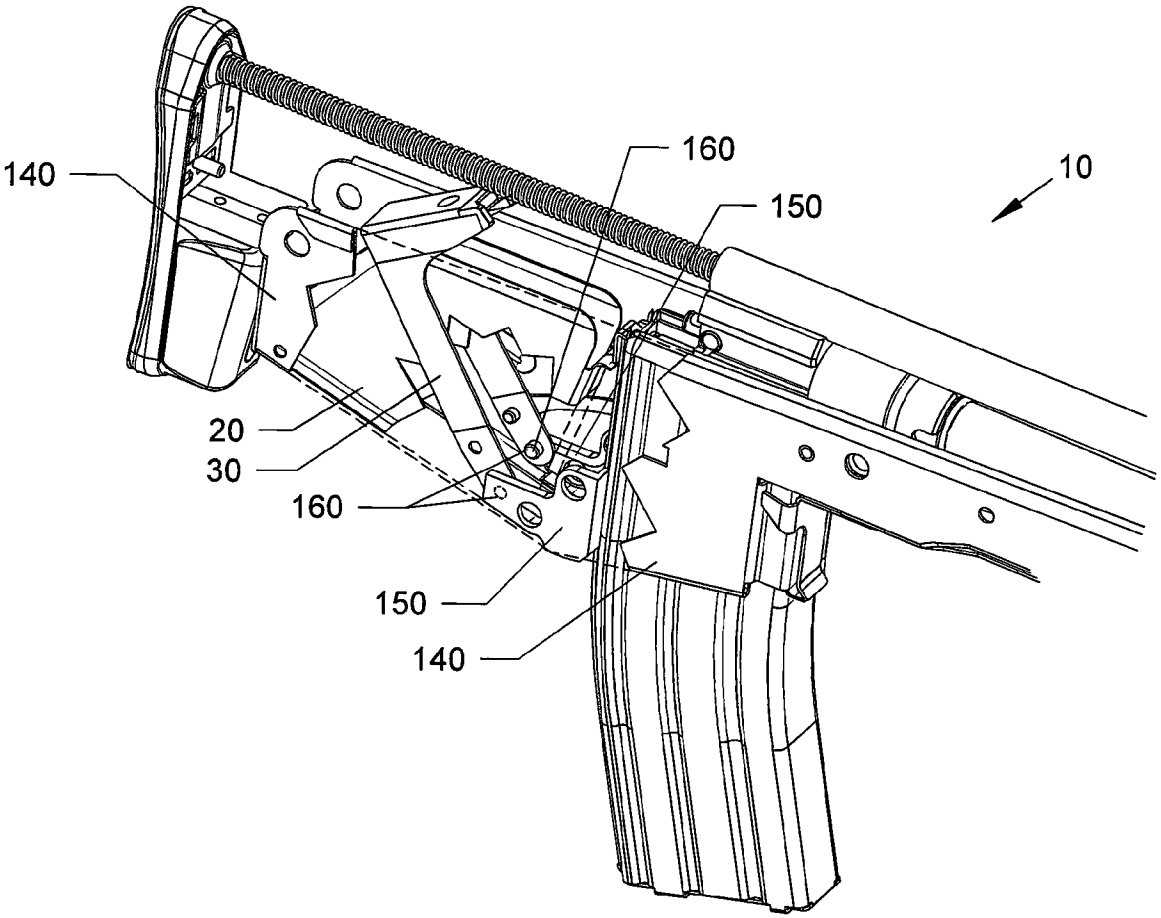
FIG. 21 is a top perspective view of the firearm with the top cover and ejection cute removed and the receiver cutaway to show how the hammer is secured to the hammer brackets and pivots on the hammer pivot pins.

FIG. 21 is a top perspective view of the firearm with the top cover removed and the receiver 140 cutaway to show how the hammer 30 is secured to the hammer brackets 150 and pivots on the hammer pivot pins 160. Referring to FIG. 7 in conjunction with FIG. 21, the hammer 30 includes two connection links on each side of the hammer 30. The lower connection points attach the hammer 30 with the hammer pivot bracket 150. The upper connection point connects the hammer 30 to the hammer bar 110. Hammer pivot pins 160 connect the hammer 30 with the hammer bar 110 and the hammer pivot bracket 150 on each side of the firearm.

Operationally, the hammer 30 rotates at the bottom around the two axes. The left and right legs of the hammer 30 (FIG. 17) are attached to a left and right hammer bar 110, one on each side of the magazine 90, connecting the hammer 30 to the trigger 100 mechanism as shown in FIG. 8.

Figure 8:
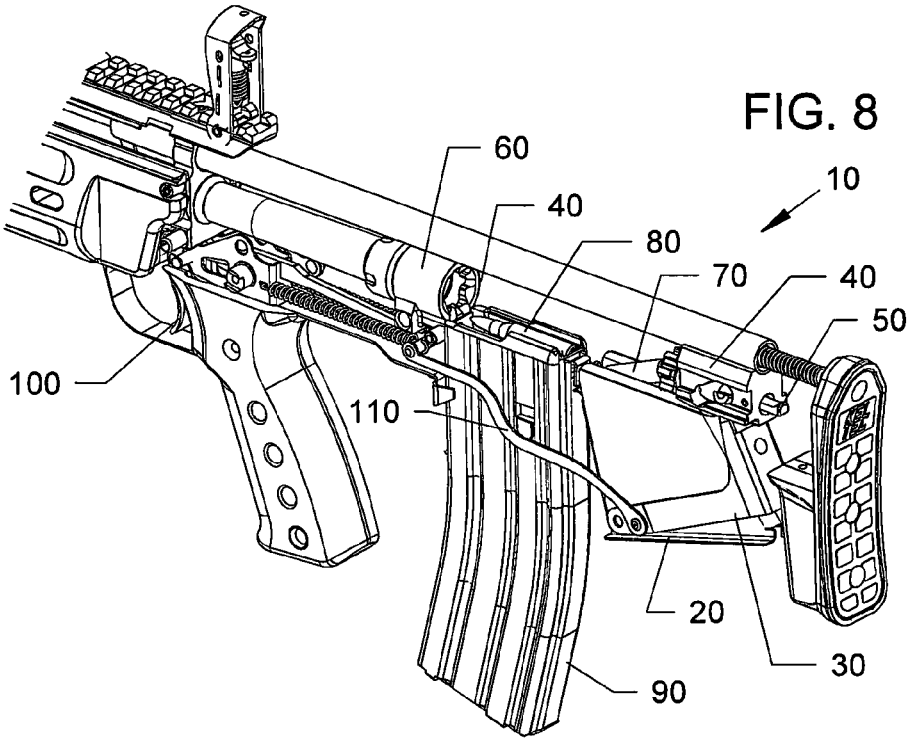
FIG. 8 shows the spent casing is ejected downwards into the ejection chute.
Figure 10:
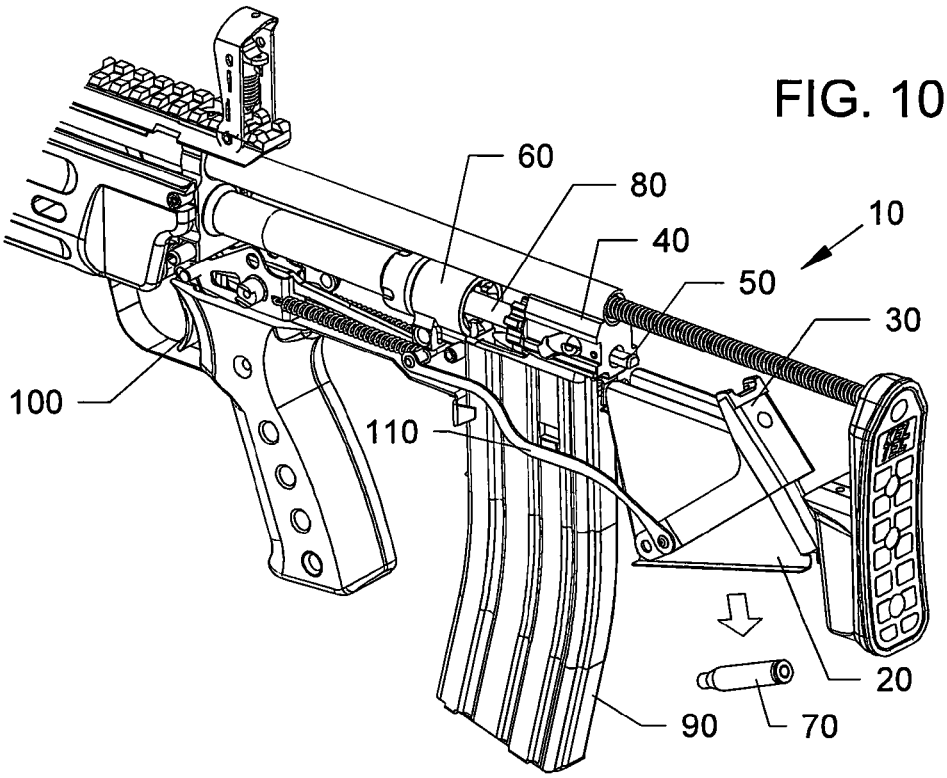
FIG. 10 shows the bolt moved forward loading the new cartridge from the magazine into the chamber to complete the cycle.

As shown in FIG. 8, the spent casing is ejected downward. In a preferred embodiment, the downward ejection is aided by a thin gauge ejection chute 20. FIG. 9 shows the spent casing 70 exiting the bottom of the ejection chute 20 as the bolt 40 moves forward to feed the next cartridge 80 from the magazine 80. FIG. 10 shows the bolt 40 moved forward loading the new cartridge 80 from the magazine 90 into the chamber 60 to complete the cycle.

FIG. 20 is a perspective view of a prior art side ejecting firearm 120 with the magazine located behind the trigger in a bullpup configuration. Casing ejection is then produced by the ejector located above the magazine, which strikes against the cartridge casing bottom during return of the bolt assembly. The cartridge is tilted laterally by the extractor and ejected through a side eject port 130 in the weapon housing. In simply configured automatic weapons, for example, in the Soviet assault rifle AK-47 (Kalaschnikov), casing ejection is produced through a protrusion fixed on the housing. The bottom of the cartridge casing strikes against this protrusion during return of the bolt assembly.

Other weapons have a casing ejector arranged in the center, so that the casings are ejected upward. For weapons of the bullpup design, a center cartridge ejector is unsuitable, since the casings, as described above, are ejected at the site at which the shooter positions his head against the weapon for aiming.

Figure 14:
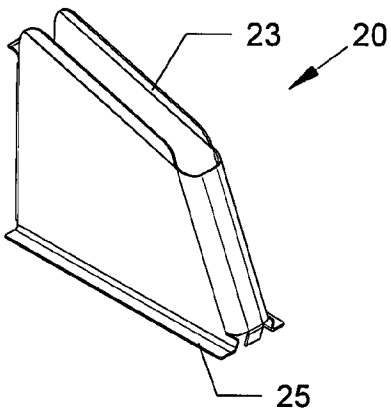
FIG. 14 is a top perspective view of the ejection chute shown in FIG. 11.
Figure 15:
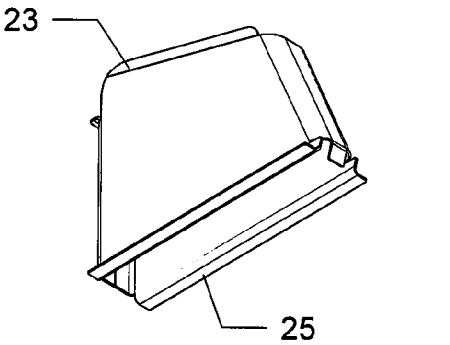
FIG. 15 is a bottom perspective view of the ejection chute shown in FIG. 11.
Figure 13:
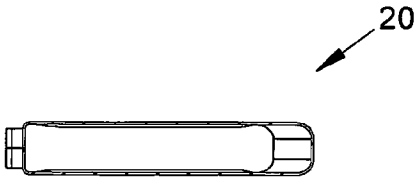
FIG. 13 is a top section view of the ejection chute shown in FIG. 11.
Figure 12:
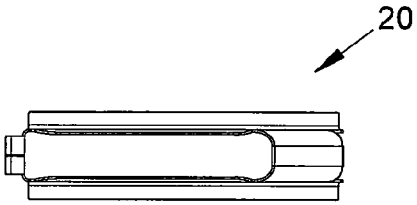
FIG. 12 is a top view of the ejection chute shown in FIG. 11.
Figure 11:
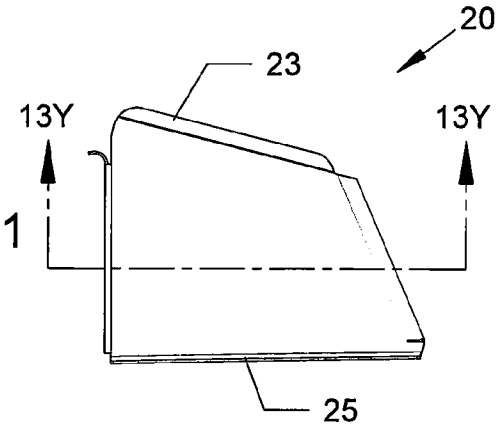
FIG. 11 is a side view of the ejection chute removed from the rifle.

Unlike the prior art side eject weapon, the downward ejection features includes the oversized hollow hammer 30 connected with the lower receiver and the trigger mechanism in conjunction with the downward ejection chute 30 connected to the lower receiver. FIG. 11 is a side view of the ejection chute 20 removed from the rifle. As shown in FIG. 10 and FIG. 11, the ejection chute 20 includes a top opening 23 to allow the spent casing 70 to enter the chute 20. FIG. 12 is a top view of the ejection chute 20 and FIG. 13 is a top section view of the ejection chute shown in FIG. 11. FIG. 14 is a top perspective view of the ejection chute 20 showing the two sides of the chute spaced a distance apart to allow the spent casing to freely pass through the chute and exit the bottom 25 of the ejection chute. FIG. 15 is a bottom perspective view of the open ejection chute 25.

The front wall of the chute 20 is generally vertical with the rear wall angling outward so that the outlet is larger than the chute inlet so that the spent cartridge/shell will easily fall out downward from the chute. The rear wall can have a curved interior edge for allowing the spent shell/cartridge to easily slide out of the chute.

While the ejection chute 20 is shown and described having a particular shape, those skilled in the art of firearms will understand that alternatives shapes can be substituted. For example, the chute shape and configuration can include a ski curved slope without deviating from the scope of the present invention. Important considerations for selecting a shape for the ejection chute include making sure the spent case can eject freely without bouncing back in and making sure the other elements such as the hammer and the hammer bar are shielded from flying cases. Another consideration when designing the ejection chute is ease of manufacturing.

Figure 16:
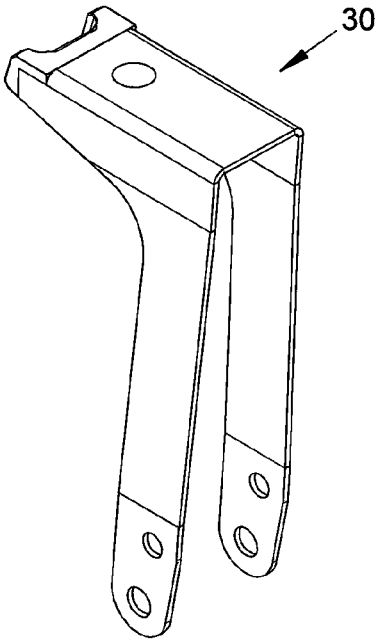
FIG. 16 is a left side perspective view of the hammer.
Figure 17:
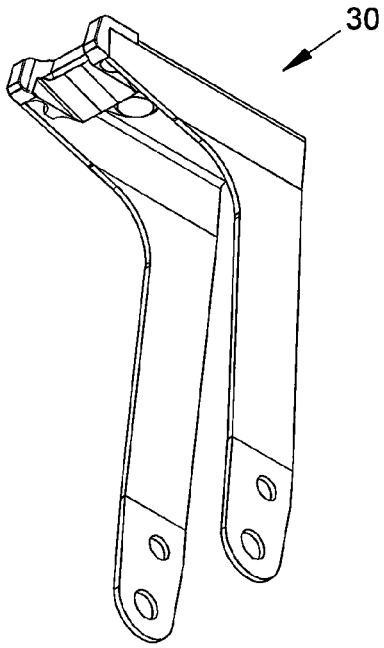
FIG. 17 is a right side perspective view of the hammer.

FIG. 16 is a left side perspective view of the oversized U-shaped hollow hammer 30 removed from the rifle. As shown, the hammer is oversized to straddle the ejection chute 20 and "hollow" to allow the spent casing to enter the ejection chute 20 without interference. The u-shaped hollow hammer includes an elongated top section forming a hammer head at a distal end, the elongated top section integrated with a left and a right leg extending downward from an opposite end of the top section, each left and right leg pivotally connected with the trigger mechanism. FIG. 17 is a right side perspective view of the hammer 30.

Figure 18:
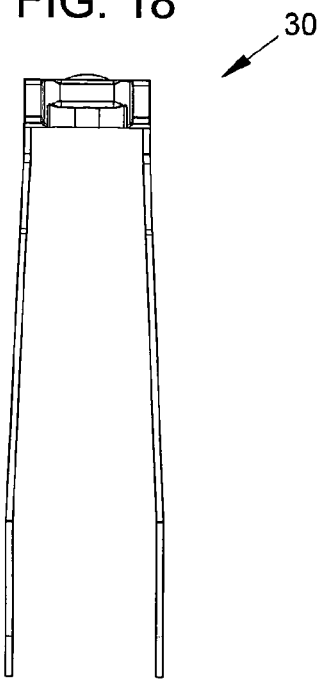
FIG. 18 is a front view of the hammer shown in FIG. 17.
Figure 19:
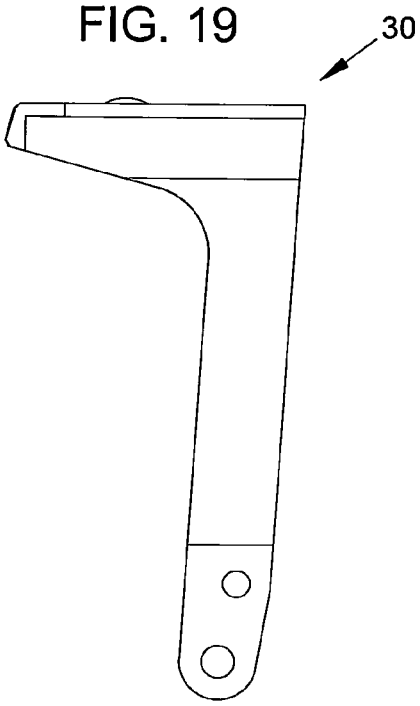
FIG. 19 is a left side view of the hammer shown in FIG. 16.

As shown in FIG. 10, the left and right legs of the hammer are pivotally connected to a right and left side of the ejection chute 20. The right and left hammer linkage 110 connects the trigger 100 with the right and left leg of the hammer 30. FIG. 18 is a front view of the hammer 30 showing the distance between the right and left leg of the u-shaped hammer 30 and FIG. 19 is a left side view of the hammer 30.

One skilled in the art should realize that the particularities in the downward ejection chute and oversized hollow hammer should not be construed as limitation of the preferred embodiment. Various configurations and corresponding components may be chosen and optimized for a particular weapon to achieve a desired downward ejection of the spent cartridge casing.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A gas operated rifle configured with a trigger and grip mounted forward of a magazine comprising:

a receiver assembly having a bolt assembly slidably located therein;

a rifle barrel connected with the receiver and having a cartridge chamber, the barrel arranged to mate with the bolt assembly located rearward of the trigger and grip;

a hollow hammer pivotally attached to a trigger mechanism; and a downward ejection chamber, the hollow hammer rotating a distance behind a magazine and below a bolt to allow a spent case withdrawn from the barrel by a bolt to be ejected downward through the hollow hammer into the downward ejection chamber.

2. The rifle of claim 1 wherein the hollow hammer comprises:

an u-shaped hammer pivotally connected at a first pivot point to a lower receiver and connected at a second pivot point to the trigger mechanism on each side of the rifle.

3. The rifle of claim 2 wherein the u-shaped hammer comprises:

an elongated top section forming a hammer head at a distal end, the elongated top section integrated with a left and a right leg extending downward from an opposite end of the top section, each left and right leg pivotally connected to the trigger mechanism.

4. The rifle of claim 3 wherein the downward ejection chamber comprises:

a rectangular hollow ejection chute connected to a lower receiver reward of the magazine below the elongated top section of the hollow hammer, the ejected case passing downward through the ejection chute.

5. A rifle for downward ejecting a spent casing from a firearm with a magazine located reward of a trigger and grip comprising:

a hollow hammer pivotally connected with a trigger assembly on each side of a magazine, the hollow hammer oversized to rotate a distance behind the magazine and below a bolt to allow a spent case withdrawn from the barrel by the bolt to be ejected downward through the hollow hammer.

6. The rifle of claim 5 wherein the hollow hammer comprises:

an elongated top section forming a hammer head at a distal end, the elongated top section integrated with a left and a right leg extending downward from an opposite end of the top section; and a left and right hammer bar pivotally connected to the left and right leg, respectively, to pivotally connect the hollow hammer with a trigger assembly on each side of the magazine.

7. The rifle of claim 6 further comprising:

a hollow ejection chute rearward of the magazine below the elongated top section of the hollow hammer with the left and right leg of the hollow hammer pivotally connected with a lower receiver on each side of the firearm, the bolt traveling rearward above the hollow ejection chute to eject the spent case through the hollow hammer into the hollow ejection chute.

8. A rifle configured with a trigger and grip mounted forward of a bottom loading magazine comprising:

a lower receiver assembly and an upper receiver assembly having a bolt carrier assembly slidably located therein, the upper receiver assembly attached to the lower receiver assembly;

a rifle barrel connected with the lower receiver assembly and having a cartridge chamber, the barrel arranged to mate with a bolt carrier mechanism located rearward of the trigger and grip; and a hollow hammer mechanism pivotally connected with a trigger assembly such that after firing the bolt mechanism travels rearward extracting a spent casing over and behind the magazine where it is ejected through the hollow hammer.

9. The rifle of claim 8 wherein the hollow hammer comprises:

a u-shaped hollow hammer including an elongated top section forming a hammer head at a distal end, the elongated top section integrated with a left and a right leg extending downward from an opposite end of the top section, each left and right leg pivotally connected on both sides with a trigger assembly.

10. The rifle of claim 9 wherein the left and the right leg of the hollow hammer is connected to a left and a right hammer bar connected with the trigger assembly on each side of the magazine to allow the hollow hammer to rotate about a first axis and the left and the right leg of the hollow hammer is connected to a left and right side of the lower receiver assembly to allow the hollow hammer to pivot about a second axis below the first axis.

11. The rifle of claim 9, further comprising:

a left and right hammer pivot bracket connected with the lower receiver assembly for pivotally connecting the hollow hammer with the lower receiver assembly to allow the hollow hammer to pivot about a second axis below a first axis, wherein the left and the right leg of the hollow hammer is connected to a left and right hammer pivot bracket, respectively, the left and right pivot bracket connected to the lower receiver assembly to pivotally connect the hollow hammer to the lower receiver assembly.

12. The rifle of claim 9 further comprising:

a rectangular hollow ejection chute reward of the magazine below the elongated top section of the hollow hammer between the left and right leg of the hollow hammer, the ejected case passing through the hollow hammer downward through the ejection chute.

13. The rifle of claim 12, wherein the rectangular hollow ejection chute is connected to the lower receiver assembly.

* * * * *